US009656789B2

(12) United States Patent
Requena

(10) Patent No.: US 9,656,789 B2
(45) Date of Patent: May 23, 2017

(54) CARTON WITH HANDLE

(71) Applicant: Graphic Packaging International, Inc., Atlanta, GA (US)

(72) Inventor: Emili Requena, Igualada (ES)

(73) Assignee: Graphic Packaging International, Inc., Atlanta, GA (US)

( * ) Notice: Subject to any disclaimer, the term of this patent is extended or adjusted under 35 U.S.C. 154(b) by 587 days.

(21) Appl. No.: 14/186,328

(22) Filed: Feb. 21, 2014

(65) Prior Publication Data

US 2014/0238882 A1 Aug. 28, 2014

Related U.S. Application Data

(60) Provisional application No. 61/850,756, filed on Feb. 22, 2013.

(51) Int. Cl.
*B65D 71/28* (2006.01)
*B65D 5/54* (2006.01)
(Continued)

(52) U.S. Cl.
CPC ..... *B65D 71/34* (2013.01); *B65D 71/36* (2013.01); *B65D 2571/0066* (2013.01);
(Continued)

(58) Field of Classification Search
CPC ..... B65D 71/34; B65D 71/36; B65D 2571/00141; B65D 2571/00469;
(Continued)

(56) References Cited

U.S. PATENT DOCUMENTS 1,253,193 A 1/1918 Hill
2,681,143 A 6/1954 Guyer
(Continued)

FOREIGN PATENT DOCUMENTS

CA 1 243 987 11/1988
DE 296 07 374 4/1996
(Continued)

OTHER PUBLICATIONS

International Search Report and Written Opinion for PCT/US2014/017628 dated Jun. 16, 2014.
(Continued)

*Primary Examiner* — Chun Cheung
(74) *Attorney, Agent, or Firm* — Womble Carlyle Sandridge & Rice, LLP

(57) ABSTRACT

A carton for containing a plurality of articles is disclosed herein. The carton can comprise a plurality of panels that extends at least partially around an interior of the carton. The plurality of panels comprises a top panel and a side panel foldably connected to the top panel. The carton further comprises at least one end flap foldably connected to the top panel and at least partially closing an end of the carton. A handle comprises a handle portion in at least the top panel and a handle flap in at least the end flap. The handle portion is connected to the handle flap. The carton comprises an upper portion that is removably attached to a tray portion. The handle being configured to carry the tray portion.

45 Claims, 9 Drawing Sheets

(51) Int. Cl.

| | |
|---|---|
| ***B31B 1/90*** | (2006.01) |
| ***B31B 1/14*** | (2006.01) |
| ***B65D 71/34*** | (2006.01) |
| ***B65D 71/36*** | (2006.01) |

(52) U.S. Cl.

CPC ..... *B65D 2571/00141* (2013.01); *B65D 2571/00469* (2013.01); *B65D 2571/00524* (2013.01); *B65D 2571/00567* (2013.01); *B65D 2571/00574* (2013.01); *B65D 2571/00728* (2013.01)

(58) Field of Classification Search

CPC ..... B65D 2570/00524; B65D 2571/00567; B65D 2571/00574; B65D 2571/0066; B65D 2571/00728

USPC ..... 206/428, 427; 229/117.12, 242

See application file for complete search history.

(56) References Cited

U.S. PATENT DOCUMENTS

| | | | | |
|---|---|---|---|---|
| 2,810,506 | A | 10/1957 | Kessler | |
| 2,842,304 | A | 7/1958 | Ringler | |
| 2,868,433 | A | 1/1959 | Anderson, Jr. | |
| 2,955,739 | A | 10/1960 | Collura | |
| 3,076,591 | A | 2/1963 | Nute et al. | |
| 3,112,856 | A | 12/1963 | MacIntosh et al. | |
| 3,300,119 | A | 1/1967 | Chaussadas | |
| 3,904,036 | A | 9/1975 | Forrer | |
| 4,036,423 | A | 7/1977 | Gordon | |
| 4,328,923 | A | 5/1982 | Graser | |
| 4,378,905 | A | 4/1983 | Roccaforte | |
| 4,470,503 | A | 9/1984 | Stone | |
| 4,482,090 | A | 11/1984 | Milliens | |
| 4,498,619 | A | 2/1985 | Roccaforte | |
| 4,546,914 | A | 10/1985 | Roccaforte | |
| 4,588,084 | A * | 5/1986 | Holley, Jr. | B65D 71/36 206/427 |
| 4,747,534 | A | 5/1988 | Marie | |
| 5,020,337 | A | 6/1991 | Krieg | |
| 5,197,598 | A | 3/1993 | Stout et al. | |
| 5,240,174 | A | 8/1993 | Wenninger | |
| 5,292,058 | A | 3/1994 | Zoss et al. | |
| 5,297,725 | A | 3/1994 | Sutherland | |
| 5,328,081 | A | 7/1994 | Saulas | |
| 5,333,734 | A | 8/1994 | Stout et al. | |
| 5,385,234 | A | 1/1995 | Stout et al. | |
| 5,482,203 | A | 1/1996 | Stout | |
| 5,495,727 | A | 3/1996 | Strong et al. | |
| 5,582,343 | A | 12/1996 | Dalvey | |
| 5,639,017 | A | 6/1997 | Fogle | |
| 5,738,273 | A * | 4/1998 | Auclair | B65D 5/46192 229/103.2 |
| 5,796,778 | A | 8/1998 | Kurker | |
| 5,873,515 | A | 2/1999 | Dunn et al. | |
| 5,878,946 | A | 3/1999 | Frerot et al. | |
| 5,915,546 | A | 6/1999 | Harrelson | |
| 5,992,733 | A | 11/1999 | Gomes | |
| 6,019,276 | A | 2/2000 | Auclair | |
| 6,065,590 | A | 5/2000 | Spivey | |
| 6,131,803 | A | 10/2000 | Oliff et al. | |
| 6,164,526 | A | 12/2000 | Dalvey | |
| 6,260,755 | B1 | 7/2001 | Bates et al. | |
| 6,631,803 | B2 | 10/2003 | Rhodes et al. | |
| 6,899,221 | B2 | 5/2005 | Skolik et al. | |
| 6,905,066 | B2 | 6/2005 | Holley et al. | |
| 6,926,193 | B2 | 8/2005 | Smalley | |
| 7,748,603 | B2 | 7/2010 | Fogle et al. | |
| 8,191,761 | B2 * | 6/2012 | Brand | B65D 5/46192 229/117.12 |
| 8,740,051 | B2 | 6/2014 | Gonzalez | |
| 2001/0017314 | A1 | 8/2001 | Boukredine et al. | |
| 2003/0015579 | A1 | 1/2003 | LeBras et al. | |
| 2005/0247767 | A1 | 11/2005 | Smalley | |
| 2006/0273143 | A1 | 12/2006 | Finch | |
| 2007/0051781 | A1 | 3/2007 | Holley, Jr. | |
| 2007/0095882 | A1 | 5/2007 | Holley, Jr. | |
| 2007/0164091 | A1 | 7/2007 | Fogle et al. | |
| 2007/0181658 | A1 | 8/2007 | Sutherland | |
| 2007/0272184 | A1 * | 11/2007 | Rommel | F01L 1/3442 123/90.17 |
| 2008/0048014 | A1 | 2/2008 | Bates | |
| 2008/0099544 | A1 | 5/2008 | Skolik | |
| 2012/0012600 | A1 * | 1/2012 | Gonzalez | B65D 71/36 220/752 |
| 2012/0211552 | A1 | 8/2012 | Kastanek et al. | |

FOREIGN PATENT DOCUMENTS

| | | |
|---|---|---|
| DE | 20 2004 018 649 | 4/2005 |
| EP | 0 754 631 | 1/1997 |
| FR | 2 481 231 | 10/1981 |
| GB | 2 206 565 | 1/1989 |
| GB | 2 422 819 A | 8/2006 |
| WO | WO 95/05324 | 2/1995 |
| WO | WO 96/01770 | 1/1996 |
| WO | WO 96/20881 | 7/1996 |
| WO | WO 96/21603 | 7/1996 |
| WO | WO 96/27538 | 9/1996 |
| WO | WO 97/44253 | 11/1997 |
| WO | WO 99/28207 | 6/1999 |
| WO | WO 00/20288 | 4/2000 |
| WO | WO 02/36440 | 5/2002 |
| WO | WO 2006/084009 | 8/2006 |
| WO | WO 2007/089282 | 8/2007 |
| WO | WO 2010/014862 A1 | 2/2010 |

OTHER PUBLICATIONS

Supplementary European Search Report for EP 14 75 4570 dated Sep. 20, 2016.

* cited by examiner

CARTON WITH HANDLE

CROSS-REFERENCED TO RELATED APPLICATIONS

This application claims the benefit of U.S. Provisional Application No. 61/850,756, filed Feb. 22, 2013.

INCORPORATION BY REFERENCE

The entire contents of U.S. Provisional Application No. 61/850,756, filed Feb. 22, 2013, are hereby incorporated by reference as if presented herein in its entirety.

BACKGROUND OF THE DISCLOSURE

The present disclosure generally relates to cartons for holding containers. More specifically, the present disclosure relates to a carton having a handle.

SUMMARY OF THE DISCLOSURE

In one aspect, the present disclosure is generally directed to a carton for containing a plurality of articles. The carton can comprise a plurality of panels that extends at least partially around an interior of the carton. The plurality of panels comprises a top panel and a side panel foldably connected to the top panel. The carton further comprises at least one end flap foldably connected to the top panel and at least partially closing an end of the carton. A handle comprises a handle portion in at least the top panel and a handle flap in at least the end flap. The handle portion is connected to the handle flap. The carton comprises an upper portion that is removably attached to a tray portion and the handle being configured to carry the tray portion In another aspect, the disclosure is generally directed to a blank for forming a carton for containing a plurality of articles. The blank includes a plurality of panels comprising a top panel and a side panel foldably connected to the top panel. At least one end flap is foldably connected to the top panel. The blank further includes a handle comprising a handle portion in at least the top panel and a handle flap in at least the end flap. The handle portion is connected to the handle flap and the carton comprises an upper portion that is removably attached to a tray portion when the carton is formed from the blank. The handle is configured to carry the tray portion when the carton is formed from the blank.

In another aspect, the disclosure is generally directed to a method of forming a carton. The method comprising obtaining a blank comprising a plurality of panels that extends at least partially around the interior of the carton. The plurality of panels comprising a top panel and a side panel. The side panel is foldably connected to the top panel. At least one end flap is foldably connected to the top panel. The blank comprises a handle comprising a handle portion in at least the top panel and a handle flap in at least the end flap. The method comprises forming an interior of the carton wherein the carton comprises an upper portion removeably attached to a tray portion. The method comprises forming a handle by connecting the handle portion to the handle flap, the handle being configured to carry the tray portion.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons for containing articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass, plastic, or metal beverage bottles) as disposed within the carton embodiments. In this specification, the terms "lower," "bottom," "upper" and "top" indicate orientations determined in relation to fully erected and upright cartons.

Figure 1:
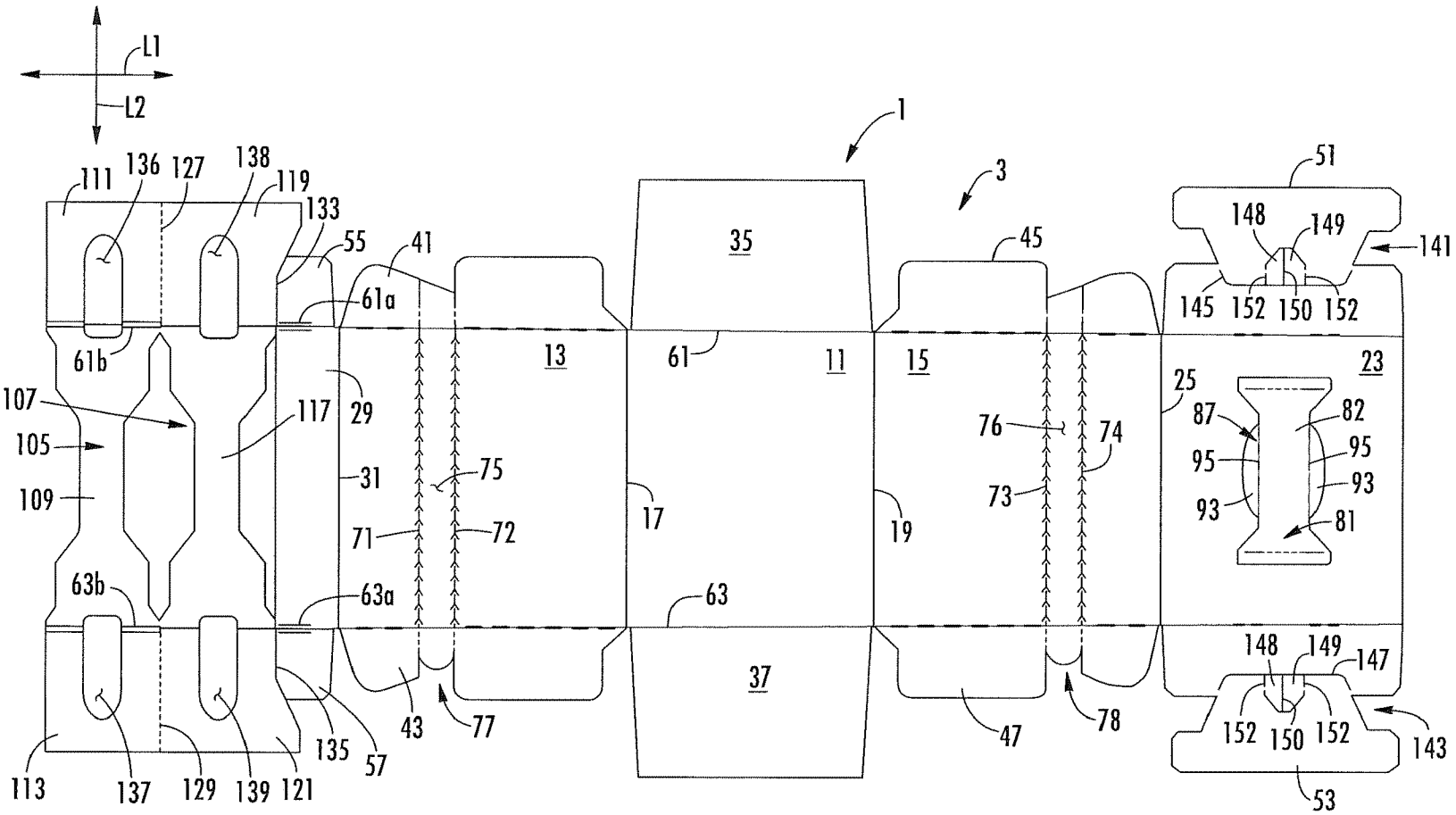
FIG. 1 is a plan view of an exterior surface of a blank for forming a carton according an embodiment of the disclosure.
Figure 7:
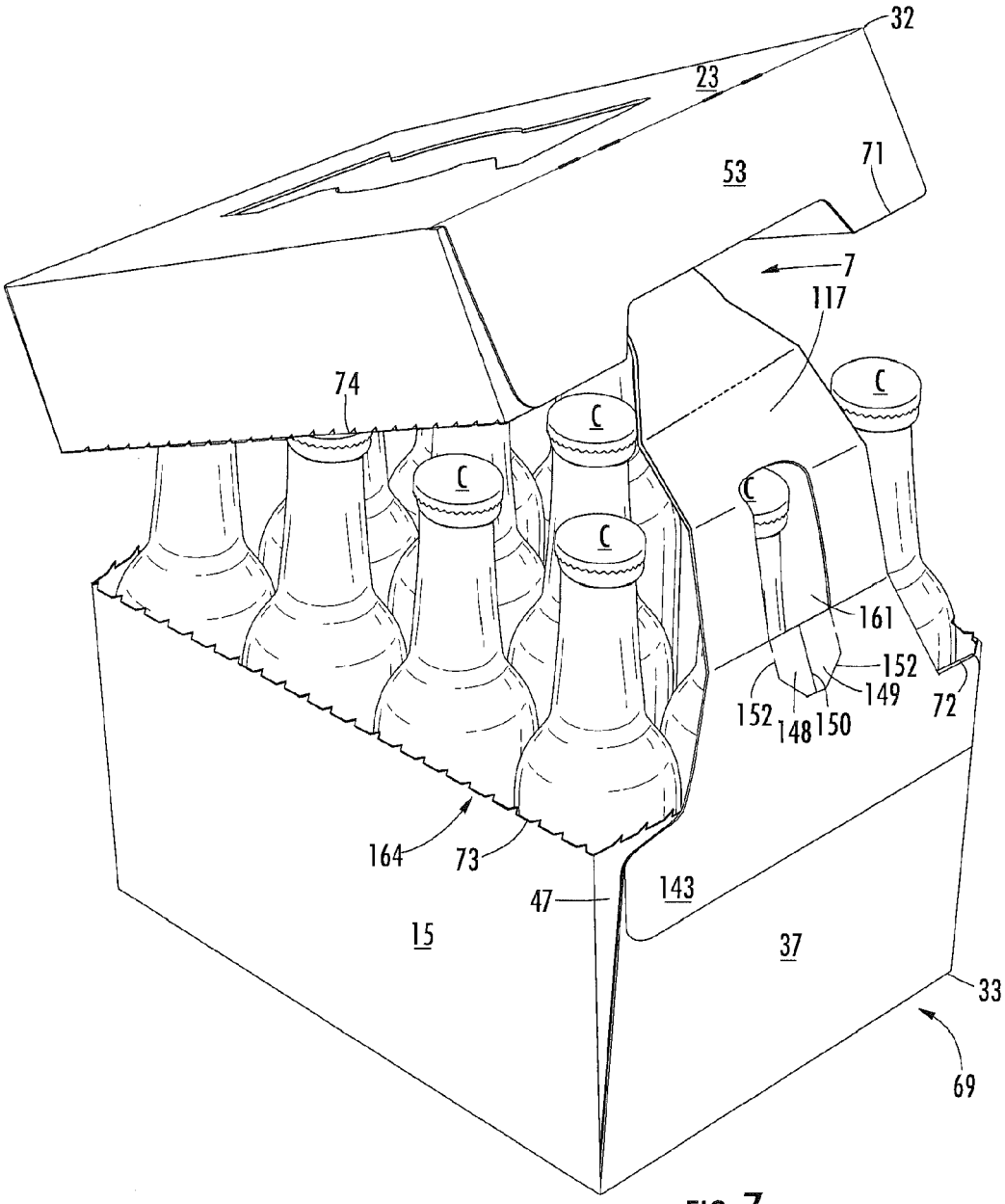

FIG. 1 is a plan view of the exterior side 1 of a blank, generally indicated at 3, used to form a carton 5 (FIG. 2) according to an exemplary embodiment of the disclosure. The carton 5 can be used to house a plurality of articles such as containers C (FIG. 7). The carton 5 has a handle, generally indicated at 7 (FIGS. 2-9), for grasping and carrying the carton. In the illustrated embodiment, the carton 5 is sized to house twelve containers C in a single layer in a 3×4 arrangement, but it is understood that the carton may be sized and shaped to hold containers of a different or same quantity in more than one layer and/or in different row/column arrangements (e.g., 1×6, 3×6, 2×6, 4×6, 2×6×2, 3×4×2, 2×9, etc.). In the illustrated embodiment, the containers C are bottles, but other types of containers can be used in the carton 5.

Figure 2:
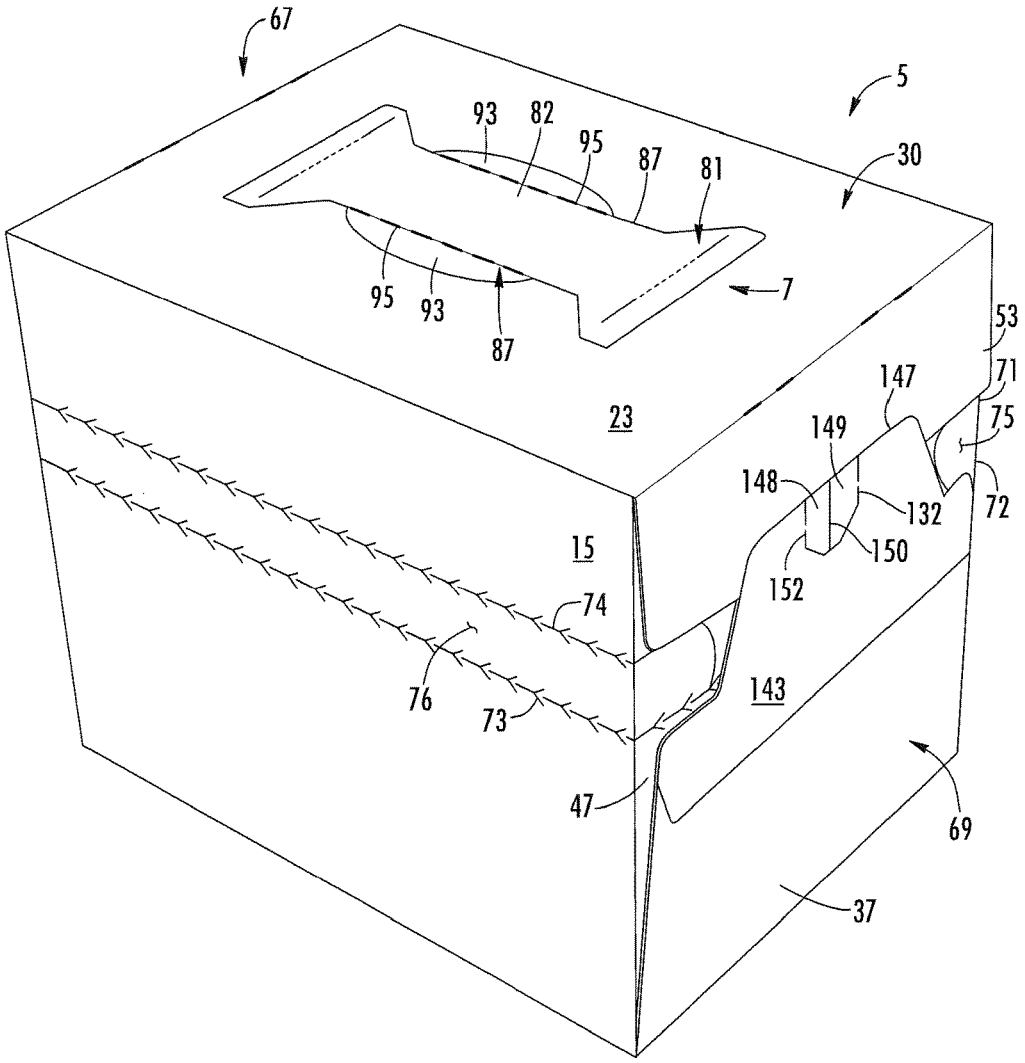
FIG. 2 is a perspective view of the assembled carton.

The blank 3 has a longitudinal axis L1 and a lateral axis L2. The blank 3 comprises a bottom panel 11 foldably connected to first and second side panels 15, 13 at respective lateral fold lines 17, 19, an outer top panel 23 foldably connected to the first side panel 15 at a lateral fold line 25, and an inner top panel 29 foldably connected to the second side panel 13 at a lateral fold line 31. The outer and inner top panels 23, 29 can at least partially overlap in the erected carton 5 to form a top wall 30 (FIG. 2).

The bottom panel 11 is foldably connected to a first bottom end flap 35 and a second bottom end flap 37. The first side panel 15 is foldably connected to a first side end flap 45 and a second side end flap 47. The second side panel 13 is foldably connected to a first side end flap 41 and a second side end flap 43. The outer top panel 23 is foldably connected to a first top end flap 51 and a second top end flap 53. The inner top panel 29 is foldably connected to a third top end flap 55 and a fourth top end flap 57.

The end flaps 35, 41, 45, 51, 55 extend along a first marginal area of the blank 3, and are foldably connected at a first longitudinal fold line 61 that extends along the length of the blank. The end flaps 37, 43, 47, 53, 57 extend along a second marginal area of the blank 3, and are foldably connected at a second longitudinal fold line 63 that also extends along the length of the blank. The longitudinal fold lines 61, 63 may be, for example, substantially straight, or oblique at one or more locations to account for blank thickness or for other factors. Additionally, portions of the longitudinal fold lines 61, 63 can be weakened areas, such as portions of the longitudinal fold lines 61, 63 that are overlapped by respective other portions of the longitudinal fold lines 61, 63. A weakened area can be two or more scores, creases, or other lines. For example, weakened areas 61*a*, 61*b* can be generally aligned with the first longitudinal fold line 61 and weakened areas 63*a*, 63*b* can be generally aligned with the second longitudinal fold line 63. When the carton 5 is erected, the end flaps 35, 41, 45, 51, 55 close a first end 67 of the carton, and the end flaps 37, 43, 47, 53, 57 close a second end 69 of the carton. In accordance with an alternative embodiment of the disclosure, different flap arrangements can be used for closing the ends 67, 69 of the carton 5.

In the illustrated embodiment, the blank 3 includes lateral tear lines 71, 72 extending across the side end flap 41, the second side panel 13, and the side end flap 43. Also, lateral tear lines 73, 74 extend across the side end flap 45, the first side panel 15, and the side end flap 47. The lateral tear lines 71, 72 define a tear strip 75 and the lateral tear lines 73, 74 define a tear strip 76 which are configured to extend between closed ends 67,69 of the carton 5 (FIG. 2). In one embodiment, the tear strips 75, 76 allow the side panels 13, 15 and the ends 67, 69 to taper inwardly from at least the respective tear lines 71, 72, 73, 74 to the top wall 30 of the carton 5. In one embodiment, the outer top panel 23 can be shorter than the bottom panel 11 in the lateral direction L2 so that some or all of each end of the carton 5 can be angled inwardly. The tear lines 71, 72, 73, 74 and tear strips 75, 76 can be otherwise shaped or positioned, or can be omitted, without departing from the disclosure.

In one embodiment, the features that comprise the handle 7 include an outer handle panel 81 that is in the outer top panel 23. The outer handle panel 81 comprises a central portion 82 in the outer top panel 23. In the illustrated embodiment, the central portion 82 of the handle panel 81 includes two handle flaps 93 foldably connected to the handle panel at respective lateral fold lines 95. As shown in FIG. 1, the ends of the outer handle panel 81 are flanged or widened with respect to the central portion 82. The periphery of the outer handle panel 81 is typically defined by a tear line 87 in the outer top panel 23, so that the outer handle panel 81 is detachable from the outer top panel 23.

In the illustrated embodiment, the inner top panel 29 comprises a first (inner) handle panel 105 and a second (intermediate) handle panel 107. The features that comprise the handle 7 also comprise the inner handle panel 105 (FIG. 3) and the intermediate handle panel 107. The inner handle panel 105 has a central portion 109 and end portions 111, 113 foldably connected to the central portion at fold lines 61, 63. Similarly, the intermediate handle panel 107 has a central portion 117 and end portions 119, 121 foldably connected to the central portion at fold lines 61, 63. In the illustrated embodiment, the central portions 109, 117 are generally narrower than the respective end portions 111, 113 and 119, 121, and the narrowness can be provided as a result of portions of the inner top panel 29 having been cut out/removed. The inner handle panel 105 is foldably connected to the intermediate handle panel 107 at respective lateral fold lines 127, 129 that foldably connect respective end portions 111, 119 and 113, 121 of respective handle panels. The intermediate handle panel 107 is detachably connected to the inner top panel 29 and top end flaps 55, 57 at respective lateral cuts or tear lines 133, 135 that extend from the inner top panel 29 into respective end flaps 55, 57. Article-receiving features of the handle 7 include respective openings 136, 137 at respective end portions 111, 113 of the inner handle panel 105 and openings 138, 139 at respective end portions 119, 121 of the intermediate handle panel 107. The handle panels 105, 107 could be otherwise shaped, arranged, and/or configured without departing from the disclosure.

In the illustrated embodiment, the features for forming the handle 7 further comprise handle flaps 141, 143 in the respective top end flaps 51, 53. In the illustrated embodiment, the handle flaps 141, 143 are defined by a respective tear line 145, 147 in a respective top end flap 51, 53, and the handle flaps are spaced apart from a respective longitudinal fold line 61, 63 and the top panel 23. Portions of the tear lines 145, 147, or all of the tear lines 145, 147, can be replaced by a cut line (e.g., the longitudinal portion of the tear lines 145, 147 could be a cut line). The article-receiving features further include article-receiving flaps 148, 149 foldably connected to each of the handle flaps 141, 143. The flaps 148, 149 can be defined by cut lines 150 and fold lines 152 extending to the respective tear lines 145, 147. The features for forming the handle 7 could be otherwise shaped, arranged, and positioned without departing from the disclosure.

In the illustrated embodiment, the blank 3 comprises features for forming a dispenser of the carton 5. The features for forming the dispenser include the at least two tear strips 75, 76 which cooperate with the tear lines 145, 147 such that an upper/lid portion 32 of the carton 5 is removable from a lower/tray portion 33, allowing dispensing of articles disposed therein, while retaining use of the handle 7 that is configured for carrying the tray portion. In one embodiment, the tray portion 33 comprises the bottom panel 11, bottom end flaps 35, 37, portions of the side panels 13, 15, portions of the end flaps 41, 43, 45, 47 and the handle 7 (illustrated in FIGS. 6-9). The upper/lid portion 32, lower/tray portion 33, tear strips 75, 76, and tear lines 145, 147 could be otherwise shaped, arranged, configured, and/or omitted without departing from the disclosure.

An exemplary method of erecting the carton 5 is discussed in detail below. At various stages in the erecting, respective portions of the blank 3 are mounted to one another in any suitable manner. For example, at various stages of the erecting process, glue or other adhesive material can be applied at various portions of the blank 3. For example, the adhesive material may or may not be present where appropriate surfaces of the blank are in face-to-face contact.

Figure 8:
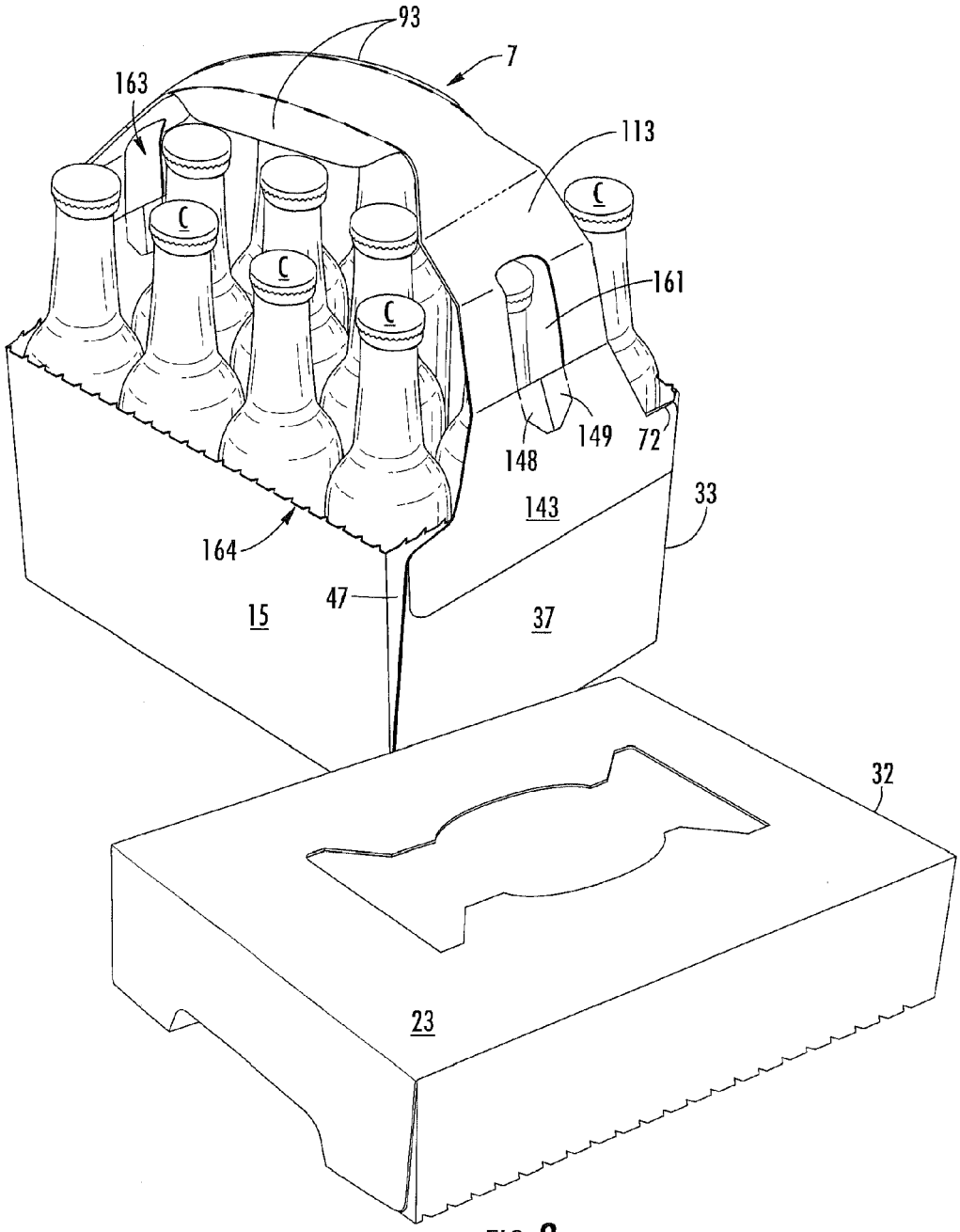
FIGS. 8-9 are perspective views of the tray with the upper portion removed.
Figure 9:
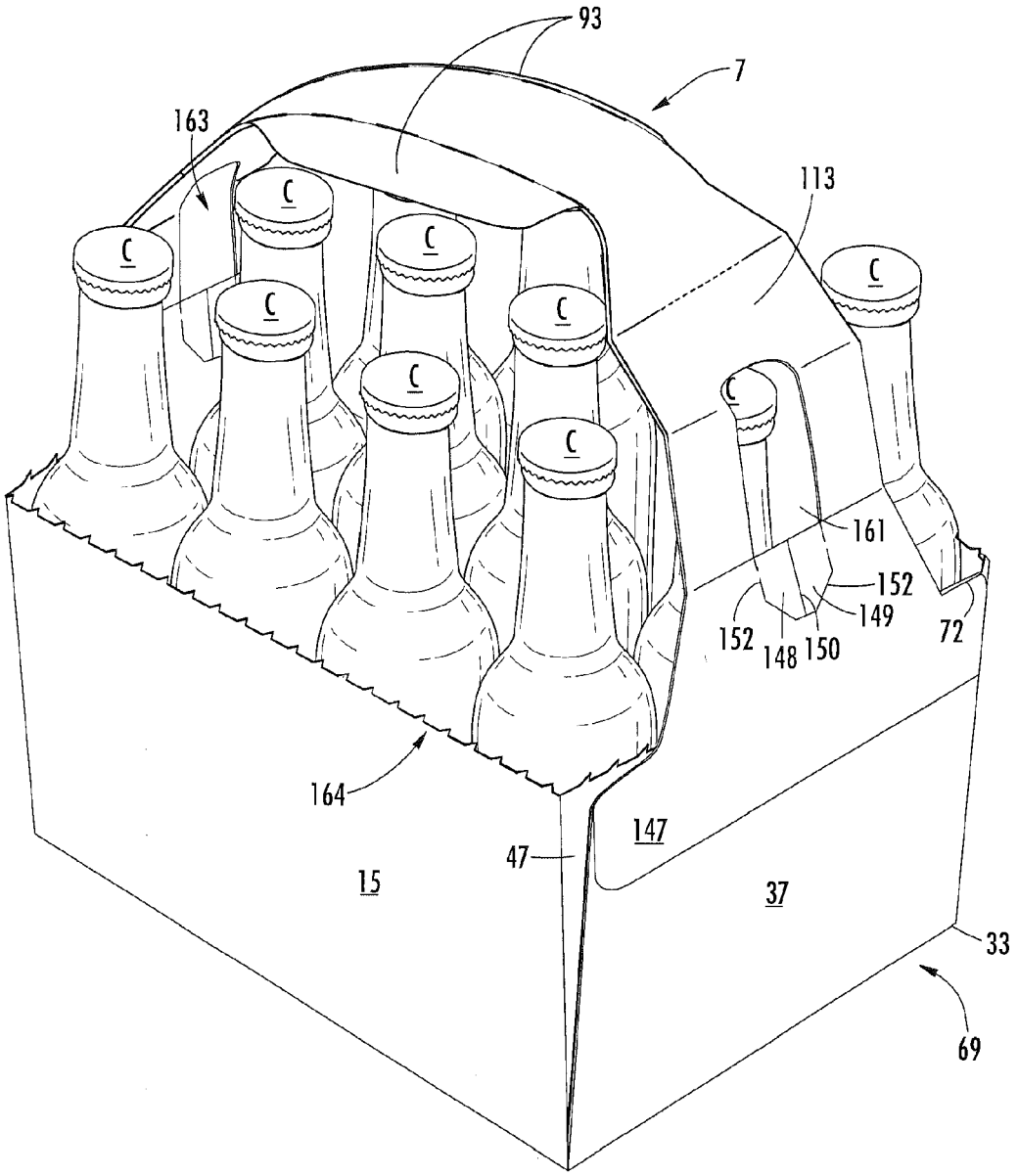

Generally, the blank 3 may be positioned such that the inner handle panel 105 is folded about fold lines 127, 129 so that the inner handle panel overlaps and is in face-to-face contact with the intermediate handle panel 107. Glue can be applied to portions of either the inner or intermediate handle panel 105, 107 to adhesively secure the inner and intermediate handle panels. When the inner and intermediate handle panels 105, 107 are overlapped, the openings 136, 138 in the respective end portions 111, 119 of the respective inner and intermediate handle panels 105, 107 are generally aligned and form a first article-receiving opening 161 (FIG. 8), and the openings 137, 139 in the respective end portions 113, 121 of the respective inner and intermediate handle panels 105, 107 are generally aligned and form a second article-receiving opening 163 (FIG. 8).

Subsequently, the blank 3 can be folded at the lateral fold line 31 to position the overlapped inner and inter mediate handle panels 105, 107 to be in face-to-face contact with the side panel 13. Next, the blank 3 is further assembled by folding at lateral fold line 17 so that the outer top panel 23, with overlapped inner and intermediate handle panels 105, 107, overlaps the inner top panel 29 to form the top wall 30, and the partially erected carton is in the form of a flattened sleeve formation. In the flattened sleeve formation, the outer handle panel 81 is in face-to-face contact with a portion of the intermediate handle panel 107 that overlaps the inner handle panel 105. Also, the handle flap 141 is in face-to-face contact with a portion of the end portion 119 of the intermediate handle panel 107, and the handle flap 143 is in face-to-face contact with a portion of the end portion 121 of the intermediate handle panel. In one embodiment, the outer handle panel 81 is adhesively secured to the central portion 117 of the intermediate handle panel 107, the handle flap 141 is adhesively secured to the end portion 119 of the intermediate handle panel 107, and the handle flap 143 is adhesively secured to the end portion 121 of the intermediate handle panel. The article-receiving features can be generally overlapped so that a portion of the article receiving-opening 161 (overlapped openings 137, 139) is generally aligned with the article-receiving flaps 148, 149 in the handle flap 141 and a portion of the article-receiving opening 163 (overlapped openings 136, 138) is generally aligned with the article-receiving flaps 148, 149 in the handle flap 143.

The flattened sleeve formation can be erected into an open-ended sleeve so that containers C can be loaded into the erected sleeve. After loading the containers C, the ends 67, 69 of the carton can be closed by at least partially overlapping and adhering the end flaps 35, 41, 45, 51, 55 at one end of the carton and at least partially overlapping and adhering the end flaps 37, 43, 47, 53, 57 at the other end of the carton. The overlapped top end flaps at each end (e.g., 53, 57 at end 69) are downwardly folded and secured to the bottom end flap (e.g., 37) and side end flaps 43, 47 at the same end. The assembled carton 5 is shown in FIG. 2. The ends 67, 69 of the carton 5 could be closed by other closing steps and features without departing from the disclosure. Additionally, alternative closing and loading sequences may be used without departing from the disclosure. For example, the containers C can be loaded into the carton 5 after closing the first end 67 or the second end 69.

Figure 3:
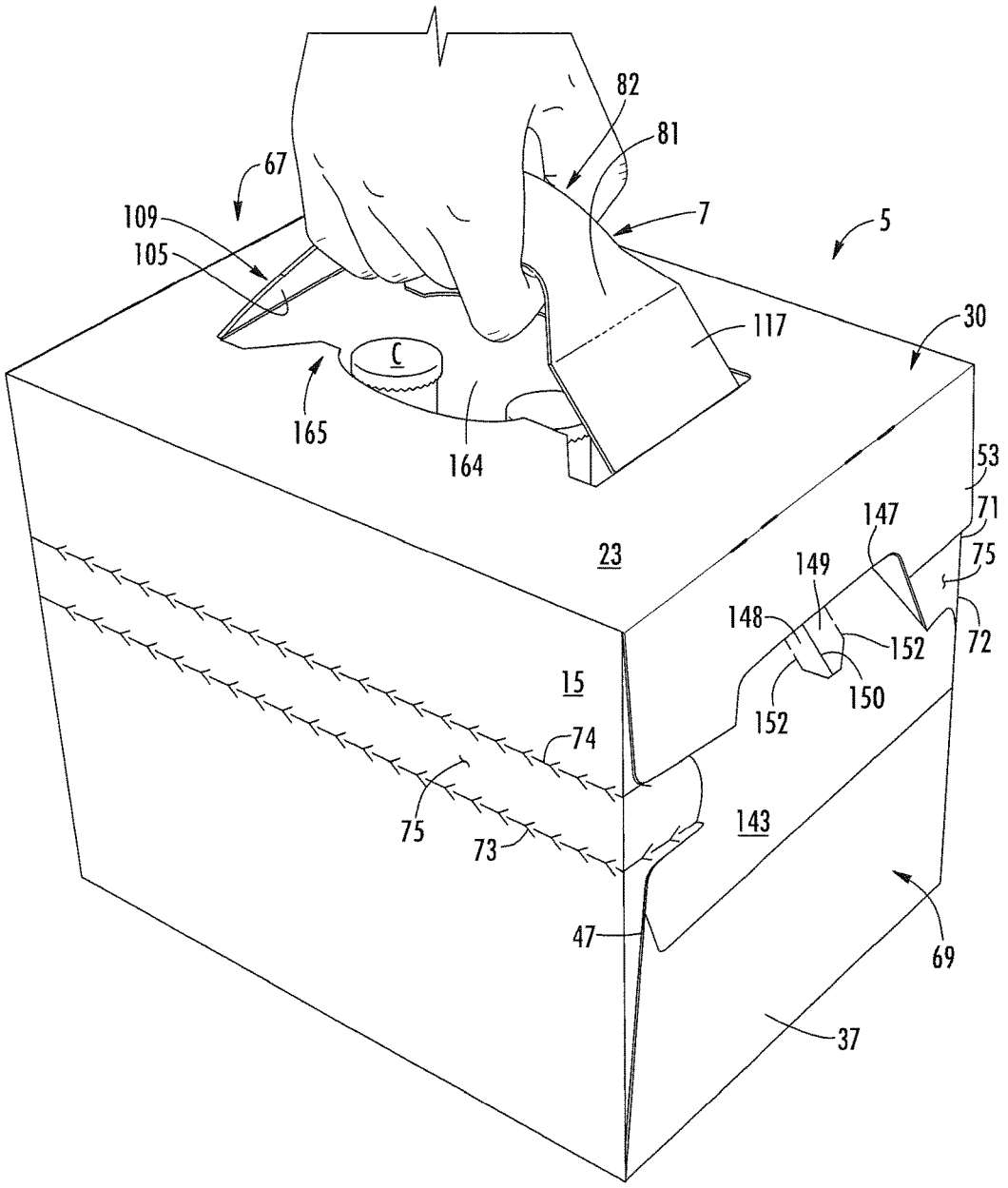
FIG. 3 is a perspective view of the assembled carton with the handle engaged.

As shown in FIG. 3, the handle 7 is activated by separating the outer handle panel 81 from the outer top panel 23 by tearing the tear line 87 to form an opening 165 in the top wall 30 exposing carton interior 164. The overlapped outer handle panel 81 and central portions 109, 117 of the inner and intermediate handle panels 105, 107 can be grasped and lifted upwardly. The handle flaps 93 can be folded downwardly to underlap the central portions 109, 117, 81 of the respective handle panels 105, 107, 81 when separating the outer handle panel 81 from the outer top panel 23. By upwardly lifting the outer handle panel 81 and overlapped central portions 109, 117, the overlapped handle flap 141 and end portions 111, 119 at one end 67 and the overlapped handle flap 143 and end portions 113, 121 at the other end 69 are caused to fold inwardly toward the interior of the carton 5. The handle flaps 141, 143 separate from the respective top end flaps 51, 53 at a respective tear line 145, 147, the overlapped end portions 111, 119 separate from end flap 55 at cut line 133, and the overlapped end portions 113, 121 separate from end flap 57 at cut line 135.

In the illustrated embodiment, the handle 7 formed from the handle features of the blank comprises three layers of material (outer handle panel 81, central portion 117 of the intermediate handle panel 107, and central portion 109 of the inner handle panel 105) in the top of the carton 5, three layers of material (handle flap 141, end portion 119 of intermediate handle panel 107, and end portion 111 of inner handle panel 105) at the first end of the carton 67, and three layers of material (handle flap 143, end portion 121 of intermediate handle panel 107, and end portion 113 of inner handle panel 105) at the second end of the carton 69. The handle 7 could have other features and could include additional or fewer reinforcing layers or portions without departing from the disclosure.

It is noted that the handle 7 is formed in a manner that has end portions in the end 67, 69 of the carton 5 while keeping the corners of the carton at the ends 67, 69, intact and free from any portion of the handle. The handle flaps 141, 143 are spaced apart from the top wall 30 so that the handle 7 extends from the carton 5 without disrupting the interior 164.

Figure 4:
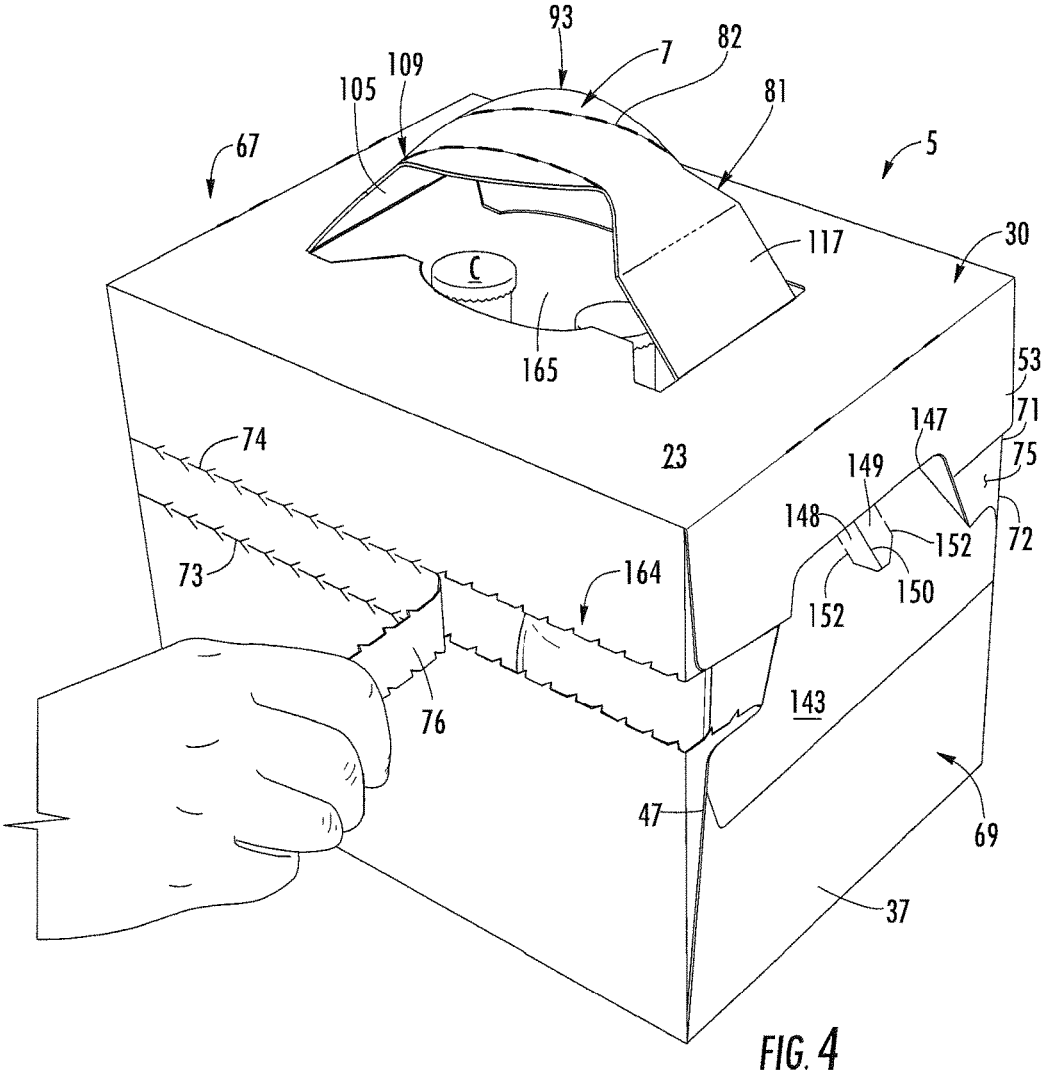
FIGS. 4-5 are perspective views of the assembled carton with the tear strips being removed.
Figure 5:
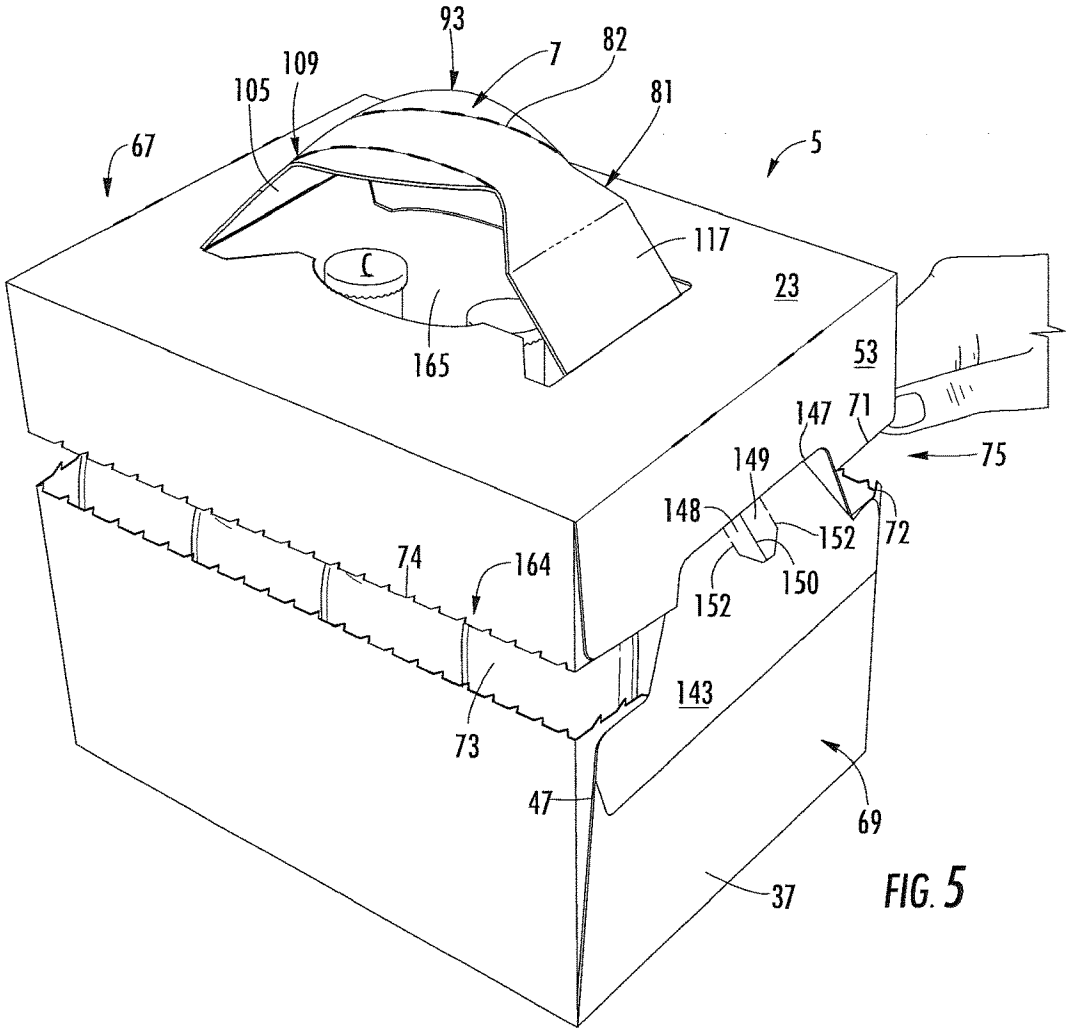
Figure 6:
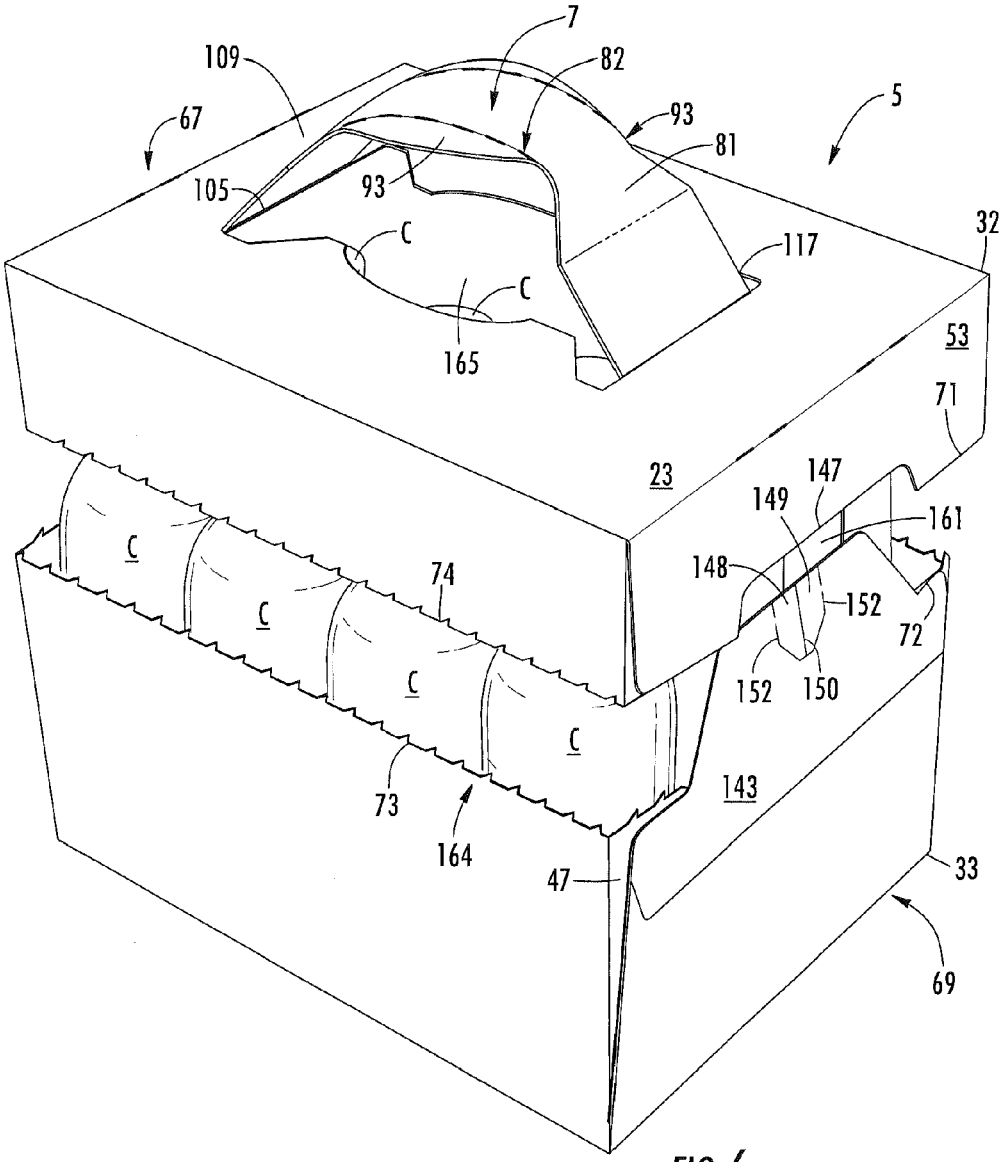
FIGS. 6-7 are perspective views of the assembled carton with the upper portion being removed.

As shown in FIGS. 4 and 5, tear strips 75, 76 may be torn away from carton 5 such that the upper or lid portion 32 is formed. As shown in FIGS. 6-9, the upper/lid portion 32 may be removed from the carrier or tray portion 33 such that the interior 164 of the carton may be easily accessed, the carrier portion 33 may be carried with handle 7, and articles C may be easily dispensed. In one embodiment the handle 7 is configured to carry the tray portion 33 by attachment of the handle flaps 141, 143 to a respective bottom end flap 35, 37. The handle panels 105, 107 being connected to the outer handle panel 81 and the handle flaps 141, 143 create a handle 7 having increased strength that allows the tray portion 33 and containers to be carried by grasping and lifting the handle. The handle 7 may be otherwise shaped, arranged, and/or configured without departing from this disclosure.

As further illustrated in FIG. 3, the article flaps 148, 149 in each of the handle flaps 141, 143 and the openings 161, 163 in the overlapped inner and intermediate handle panels 105, 107, allow the handle 7 to conform to or accommodate the end articles C that are adjacent a respective end 67, 69 of the carton 5 when the handle is lifted. One or more of the containers C adjacent or proximate the second end 69 can be received in the article-receiving opening 161 (the overlapped openings 137, 139 in the respective end portions 113, 121 of the respective handle panels 105, 107) when the handle 7 is activated. The article-receiving opening 161 and article-receiving flaps 148, 149 of the handle flap 141 at the first end of the carton can conform to or accommodate an article C, as well as article-receiving opening 163 conforming to or accommodating an article C, upon lifting of the handle 7. Accordingly, the handle 7 can be lifted upwardly relative to the top wall 30 and the ends of the handle can move inwardly from the ends 67, 69 of the carton 5 while accommodating the articles in the carton.

In the embodiments of the disclosure comprising a two-ply handle panel, or two-ply and/or three-ply portions of the handle, the caliper or thickness of the material of the blank can be increased to maintain the strength of the handle in the two-ply embodiments.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In accordance with the exemplary embodiments, the blanks may be constructed of paperboard of a caliper such that it is heavier and more rigid than ordinary paper. The blanks can also be constructed of other materials, such as cardboard, hard paper, or any other material having properties suitable for enabling the carton package to function at least generally as described above. The blanks can also be laminated to or coated with one or more sheet-like materials at selected panels or panel sections.

In accordance with the exemplary embodiments of this disclosure, a fold line can be any substantially linear, although not necessarily straight, form of weakening that facilitates folding therealong. More specifically, but not for the purpose of narrowing the scope of this disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue. The term "glue" is intended to encompass all manner of adhesives commonly used to secure carton panels or flaps in place.

The foregoing description of the disclosure illustrates and describes various exemplary embodiments. Various additions, modifications, changes, etc., could be made to the exemplary embodiments without departing from the spirit and scope of the invention as set forth in the claims. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the claims, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a plurality of articles, the carton comprising:

a plurality of panels that extends at least partially around an interior of the carton, the plurality of panels comprises a top panel, a bottom panel, and a side panel foldably connected to each of the top panel and the bottom panel;

at least one top end flap foldably connected to the top panel and at least partially closing an end of the carton;

at least one bottom end flap foldably connected to the bottom panel and at least partially closing an end of the carton; and a handle comprising a handle portion in at least the top panel and a handle flap detachably connected to at least the at least one top end flap along a tear line, the handle portion is connected to the handle flap, the handle flap is attached to the at least one bottom end flap, and the carton comprising an upper portion that is removably attached to a tray portion, the handle being configured to carry the tray portion.

2. The carton of claim 1, wherein the top panel is an outer top panel, the side panel is a first side panel, the plurality of panels comprises an inner top panel and a second side panel, the outer top panel is foldably connected to the first side panel and the inner top panel is foldably connected to the second side panel.

3. The carton of claim 2, wherein the bottom panel is foldably connected to the first side panel and the second side panel, and the at least one bottom end flap comprises a first bottom end flap and a second bottom end flap respectively foldably connected to the bottom panel.

4. The carton of claim 2, wherein the handle flap is a first handle flap, the carton further comprising a second handle flap, and the at least one top end flap comprises a first top end flap and a second top end flap respectively foldably connected to the outer top panel, the first handle flap is detachably connected to the first top end flap and the second handle flap is detachably connected the second top end flap.

5. The carton of claim 4, wherein the handle further comprises at least one inner handle panel in the inner top panel, the handle portion is in the outer top panel, the outer handle panel being connected to at least one of the first handle flap and the second handle flap by connection to the at least one inner handle panel.

6. The carton of claim 5, wherein the at least one inner handle panel comprises a first inner handle panel foldably connected to a second inner handle panel.

7. The carton of claim 6, wherein at least a portion of the second inner handle panel is in face-to-face contact with at least a portion of the first inner handle panel.

8. The carton of claim 7, wherein at least a portion of the outer handle panel is in face-to-face contact with at least a portion of the second inner handle panel.

9. The carton of claim 5 further comprises a first tear strip and a second tear strip, the first tear strip is at least partially defined in the first side panel and the second tear strip is at least partially defined in the second side panel.

10. The carton of claim 9, wherein the upper portion and the tray portion are separated by the first tear strip and the second tear strip.

11. The carton of claim 9, wherein the first tear strip and the second tear strip are defined by a first tear line and a second tear line.

12. The carton of claim 11, wherein the at least one end flap further comprises a first side end flap and a second side end flap respectively foldably connect to each of the first side panel and the second side panel, the first tear strip and the second tear strip extend into a respective first side end flap and second side end flap.

13. The carton of claim 8, wherein:

the first inner handle panel and the second inner handle panel comprise a central portion, a first end portion, and a second end portion;

the first end portion and the second end portion of the second inner handle panel are secured to a respective interior surface of a respective one of the first handle flap and the second handle flap.

14. The carton of claim 13, wherein the handle further comprises article-receiving features in at least one of the first end portion and the second end portion of the first inner handle panel and the second inner handle panel, the article-receiving features being for receiving at least a portion of at least one article of the plurality of articles.

15. The carton of claim 14, wherein:

the article-receiving features comprise an article-receiving opening extending in the at least one end portion of the first handle panel and the second handle panel and at least two article-receiving flaps foldably connected to at least one of the first handle flap and the second handle flaps.

16. The carton of claim 15, wherein the article-receiving flaps are generally aligned with the article-receiving opening in the at least one end portion.

17. The carton of claim 4, wherein the first handle flap and the second handle flap are at least partially in face-to-face contact with a respective one of the first bottom end flap and the second bottom end flap.

18. The carton of claim 17, wherein the tray comprises the bottom panel, the first bottom end flap, the second bottom end flap, the first handle flap, the second handle flap, and the handle.

19. A blank for forming a carton for containing a plurality of articles, the blank comprising:

a plurality of panels comprising a top panel, a bottom panel, and a side panel foldably connected to each of the top panel and the bottom panel;

at least one top end flap foldably connected to the top panel;

at least one bottom end flap foldably connected to the bottom panel; and a handle comprising a handle portion in at least the top panel and a handle flap detachably connected to at least the at least one top end flap along a tear line, the handle portion is connected to the handle flap when the carton is formed from the blank, the handle flap is attached to the at least one bottom end flap when the carton is formed from the blank; and the carton formed from the blank comprising an upper portion that is removably attached to a tray portion, the handle being configured to carry the tray portion when the carton is formed from the blank.

20. The blank of claim 19, wherein the top panel is an outer top panel, the side panel is a first side panel, the plurality of panels comprises an inner top panel and a second side panel, the outer top panel is foldably connected to the first side panel and the inner top panel is foldably connected to the second side panel.

21. The blank of claim 20, wherein the bottom panel is foldably connected to the first side panel and the second side panel, and the at least one bottom end flap comprises a first bottom end flap and a second bottom end flap respectively foldably connected to the bottom panel.

22. The blank of claim 20, wherein the handle flap is a first handle flap and the blank further comprises a second handle flap, and the at least one top end flap comprises a first top end flap and a second top end flap respectively foldably connected to the outer top panel, the first handle flap is detachably connected to the first top end flap and the second handle flap is detachably connected the second top end flap.

23. The blank of claim 22, wherein the handle further comprises at least one inner handle panel in the inner top panel, the handle portion is in the outer top panel, the outer handle panel is for being connected to at least one of the first handle flap and the second handle flap by connection to the at least one inner handle panel when the blank is formed into a carton.

24. The blank of claim 23, wherein the at least one inner handle panel comprises a first inner handle panel foldably connected to a second inner handle panel.

25. The blank of claim 24, wherein at least a portion of the second inner handle panel is in face-to-face contact with at least a portion of the first inner handle panel when the blank is formed into a carton.

26. The blank of claim 25, wherein at least a portion of the outer handle panel is in face-to-face contact with at least a portion of the second inner handle panel when the blank is formed into a carton.

27. The blank of claim 23, further comprises a first tear strip and a second tear strip, the first tear strip is at least partially defined in the first side panel and the second tear strip is at least partially defined in the second side panel.

28. The blank of claim 27, wherein the upper portion and the tray portion are separated by the first tear strip and the second tear strip when the blank is formed into a carton.

29. The blank of claim 27, wherein the first tear strip and the second tear strip are defined by a first tear line and a second tear line.

30. The blank of claim 29, wherein the at least one end flap further comprises a first side end flap and a second side end flap respectively foldably connect to each of the first side panel and the second side panel;

the first tear strip and the second tear strip extend into a respective first side end flap and second side end flap.

31. The blank of claim 26, wherein:

the first inner handle panel and the second inner handle panel comprise a central portion, a first end portion, and a second end portion;

the first end portion and the second end portion of the second inner handle panel are secured to a respective interior surface of a respective one of the first handle flap and the second handle flap when the blank is formed into a carton.

32. The blank of claim 31, wherein the handle further comprises article-receiving features in at least one of the first end portion and the second end portion of the first inner handle panel and the second inner handle panel, the article-receiving features being for receiving at least a portion of at least one article of the plurality of articles when the blank is formed into a carton.

33. The blank of claim 32, wherein:

the article-receiving features comprise an article-receiving opening extending in the at least one end portion of the first handle panel and the second handle panel and at least two article-receiving flaps foldably connected to at least one of the first handle flap and the second handle flaps.

34. A method of forming a carton, the method comprising:

obtaining a blank, the blank comprising a plurality of panels comprising a top panel, a bottom panel, and a side panel foldably connected to each of the top panel and the bottom panel, at least one top end flap foldably connected to the top panel, at least one bottom end flap foldably connected to the bottom panel, and a handle comprising a handle portion in at least the top panel and a handle flap detachably connected to at least the at least one top end flap along a tear line;

forming an interior of the carton, the carton comprising an upper portion removeably attached to a tray portion;

attaching the handle flap to the at least one bottom end flap; and forming a handle by connecting the handle portion to the handle flap, the handle being configured to carry the tray portion.

35. The method of claim 34, wherein the top panel is an outer top panel, the side panel is a first side panel, the plurality of panels comprises an inner top panel and a second side panel, the outer top panel is foldably connected to the first side panel and the inner top panel is foldably connected to the second side panel;

the handle flap is a first handle flap and a second handle flap; and the end flap comprises a first top end flap and a second top end flap respectively foldably connected to the outer top panel, the forming of the handle comprises connecting the first handle flap to the first top end flap and connecting the second handle to the second top end flap.

36. The method of claim 35, wherein the handle further comprises at least one inner handle panel in the inner top panel, the handle portion is in the outer top panel, the forming the handle comprises connecting the outer handle panel to at least one of the first handle flap and the second handle flap by connection to the at least one inner handle panel.

37. The method of claim 36, wherein the at least one inner handle panel comprises a first inner handle panel foldably connected to a second inner handle panel.

38. The method of claim 37, wherein the forming the handle comprises positioning at least a portion of the second inner handle panel in face-to-face contact with at least a portion of the first inner handle panel.

39. The method of claim 38, wherein the forming the handle comprises positioning at least a portion of the outer handle panel in face-to-face contact with at least a portion of the second inner handle panel.

40. The method of claim 39, wherein:

the first inner handle panel and the second inner handle panel comprise a central portion, a first end portion, and a second end portion; and the forming the handle comprises securing the first end portion and the second end portion of the second inner handle panel to a respective interior surface of a respective one of the first handle flap and the second handle flap.

41. The method of claim 35 further comprising separating the upper portion from the tray portion.

42. The method of claim 41, wherein the blank comprises a first tear strip and a second tear strip; the first tear strip is at least partially defined in the first side panel and the second tear strip is at least partially defined in the second side panel; and the separating the upper portion from the tray portion comprises tearing along the first tear strip and the second tear strip.

43. The carton of claim 1, wherein the handle flap is spaced apart from the top panel.

44. The blank of claim 19, wherein the handle flap is spaced apart from the top panel.

45. The method of claim 34, wherein the handle flap is spaced apart from the top panel.

* * * * *